US007234703B1

(12) United States Patent
Kusz

(10) Patent No.: US 7,234,703 B1
(45) Date of Patent: Jun. 26, 2007

(54) DIVING GAME ASSEMBLY AND METHOD

(76) Inventor: Merry Jane K. Kusz, 4931 S. 68th St., Greenfield, WI (US) 53220

( * ) Notice: Subject to any disclaimer, the term of this patent is extended or adjusted under 35 U.S.C. 154(b) by 232 days.

(21) Appl. No.: 11/174,344

(22) Filed: Jul. 5, 2005

(51) Int. Cl.
*A63B 67/00* (2006.01)
*A63B 71/00* (2006.01)
*A63F 9/00* (2006.01)
*A63H 23/00* (2006.01)

(52) U.S. Cl. ..... 273/445; 273/440; 446/153

(58) Field of Classification Search ..... 446/153, 446/161; 273/445–44, 440, 459; 434/254; 472/128

See application file for complete search history.

(56) References Cited

U.S. PATENT DOCUMENTS

| | | | | |
|---|---|---|---|---|
| 163,086 | A | 5/1875 | Lee | |
| 3,707,289 | A * | 12/1972 | Wicks | 273/139 |
| D281,591 | S | 12/1985 | Hikiss | |
| 4,737,134 | A | 4/1988 | Rumsey | |
| 4,890,838 | A * | 1/1990 | Rudell et al. | 273/138.1 |
| 5,136,621 | A * | 8/1992 | Mitchell et al. | 377/24.2 |
| 5,316,293 | A | 5/1994 | Hamilton | |
| 5,520,387 | A | 5/1996 | Snow | |
| 5,810,364 | A * | 9/1998 | Canion | 273/459 |
| 5,992,853 | A * | 11/1999 | Rudell et al. | 273/287 |
| 6,220,599 | B1 * | 4/2001 | Eisch | 273/457 |
| 6,319,120 | B1 * | 11/2001 | Motosko | 463/7 |
| 6,332,822 | B2 * | 12/2001 | Greenberg et al. | 446/153 |
| 6,733,149 | B1 | 5/2004 | Chuang | |

* cited by examiner

*Primary Examiner*—Eugene Kim
*Assistant Examiner*—Alyssa M. Hylinski

(57) ABSTRACT

A diving game assembly and method includes a non-buoyant housing. A digital timer is mounted in the housing and is configured to count down from a selected number of minutes and seconds down to zero seconds. A power supply is electrically coupled to the timer. The timer includes a digital display for displaying the number of minutes and seconds remaining on the timer. To use the assembly, the timer is set, started, and then the housing is thrown into a pool of water. Players then attempt to bring the housing to the surface of the water before the timer reaches zero seconds.

6 Claims, 4 Drawing Sheets

DIVING GAME ASSEMBLY AND METHOD

BACKGROUND OF THE INVENTION

1. Field of the Invention

The present invention relates to diving toy devices and more particularly pertains to a new diving toy device for providing an entertaining diving game which includes the retrieval of an object from the bottom of a pool.

2. Description of the Prior Art

The use of diving toy devices, and in particular toy bomb devices, is known in the prior art. U.S. Pat. No. 163,086 describes a toy bomb device which resembles a spherical bomb having a fuse coupled thereto. Another such device is found in U.S. Pat. No. 5,520,387 and includes a toy bomb and game therefore having a toy bomb which resembles a rocket. A more general toy which emits an audible signal is found in U.S. Pat. No. 5,316,293.

While these devices fulfill their respective, particular objectives and requirements, the need remains for a device which resembles a bomb and which can be thrown into a pool of water and retrieved in order to score points. The device preferably includes a timer which can be selectively set by persons playing with the device.

SUMMARY OF THE INVENTION

The present invention meets the needs presented above by generally comprising providing a non-buoyant housing. A digital timer is mounted in the housing and is configured to count down from a selected number of minutes and seconds down to zero seconds. A power supply is electrically coupled to the timer. The timer includes a digital display for displaying the number of minutes and seconds remaining on the timer. To use the present invention, the timer is set, started, and then the housing is thrown into a pool of water. Players then attempt to bring the housing to the surface of the water before the timer reaches zero seconds.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
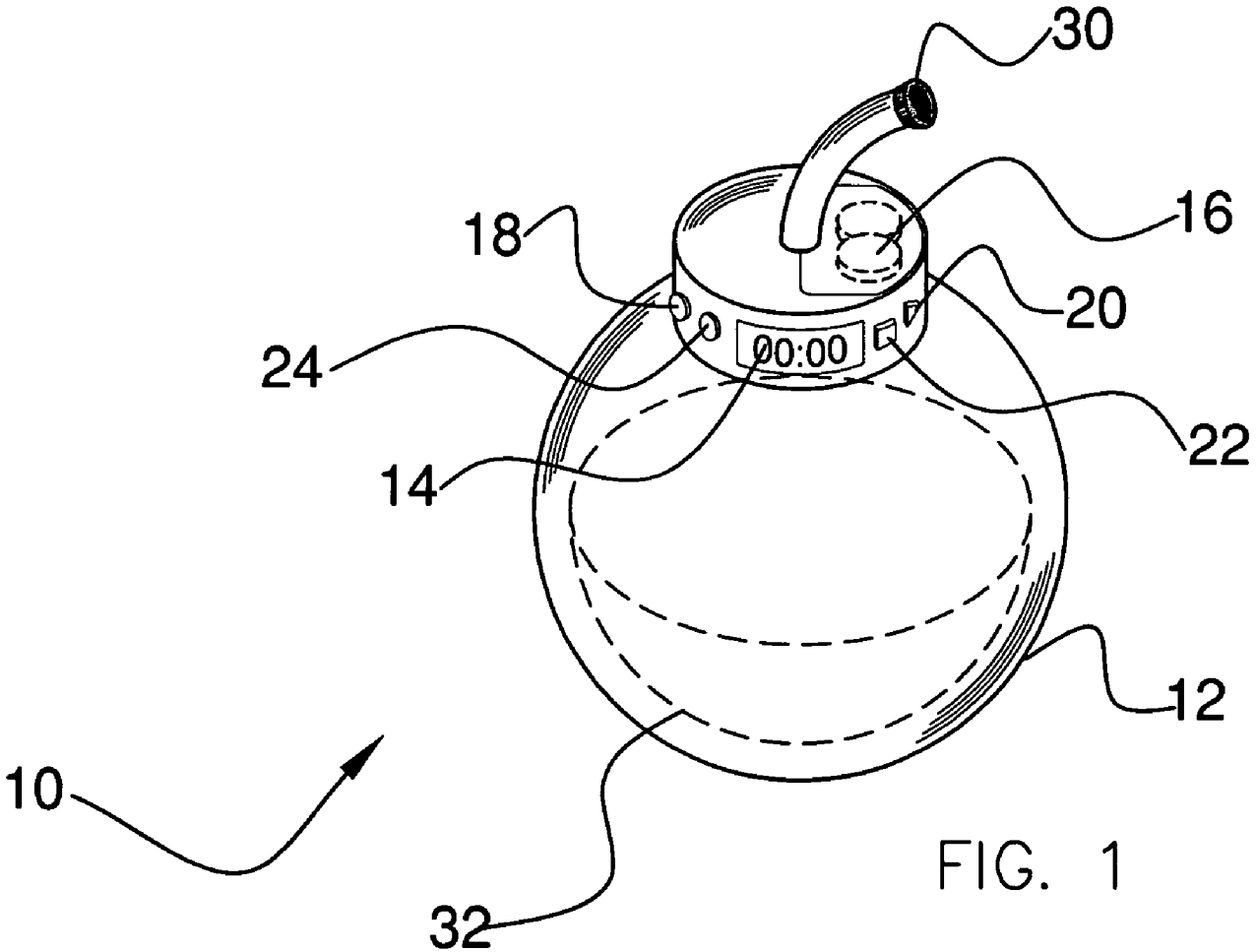
FIG. 1 is a perspective view of a first embodiment of a diving game assembly and method according to the present invention.
Figure 2:
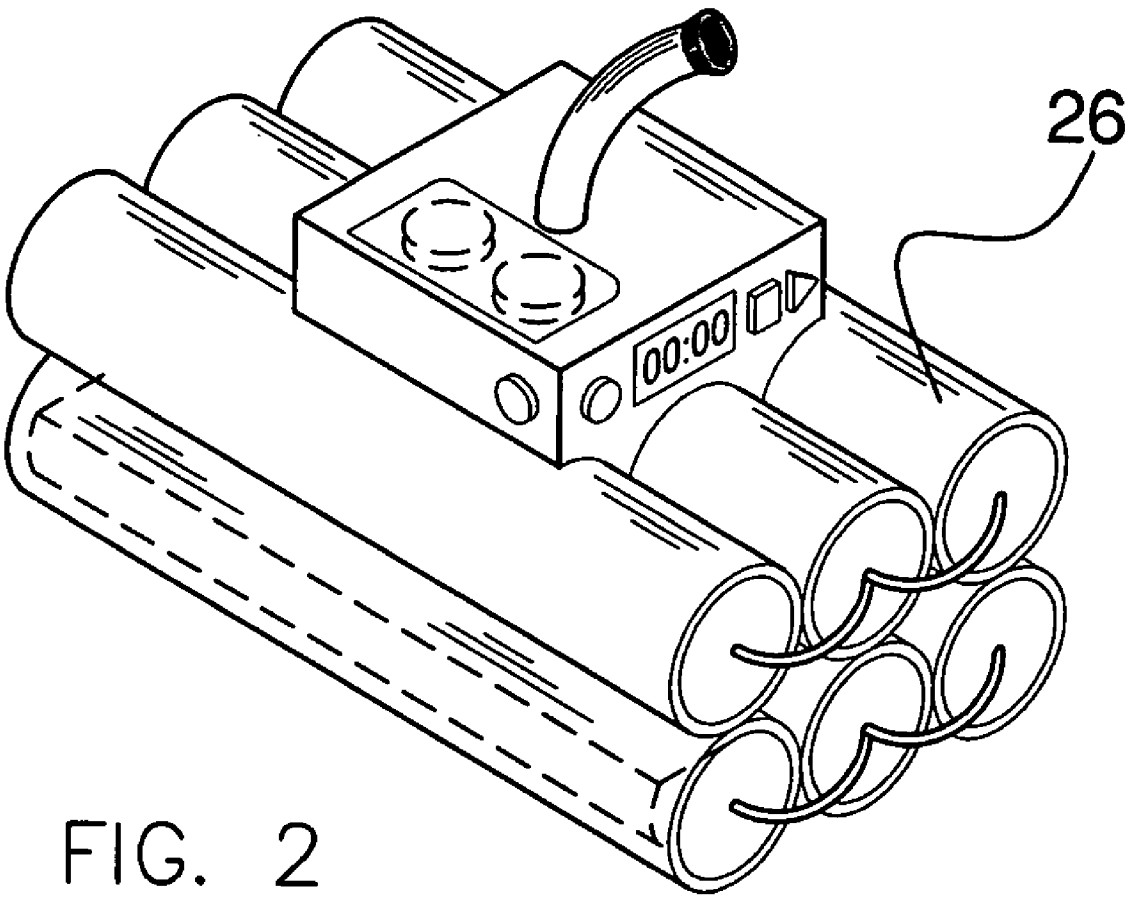
FIG. 2 is a perspective view of a second embodiment of the present invention.
Figure 3:
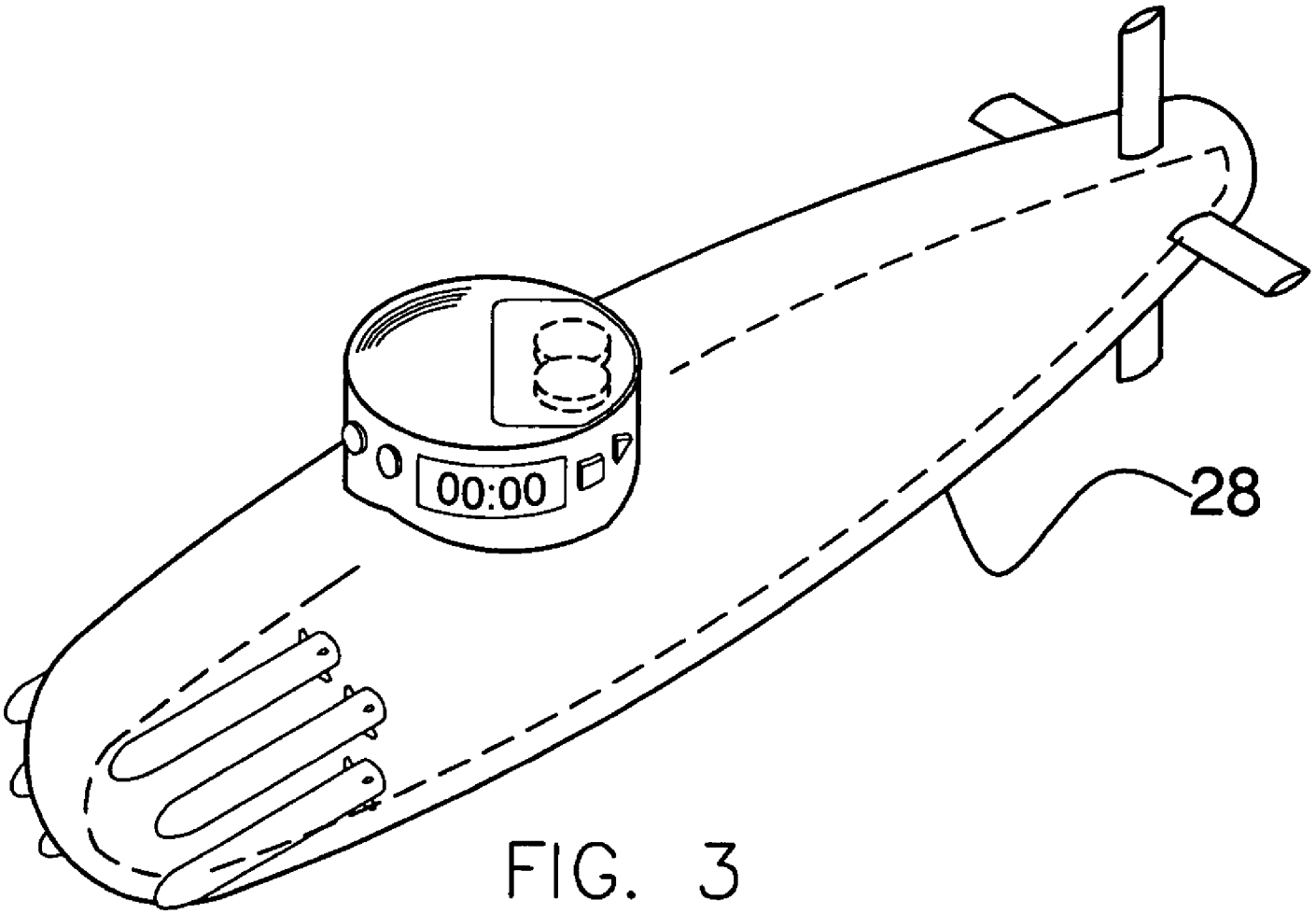
FIG. 3 is a perspective view of a third embodiment of the present invention.
Figure 4:
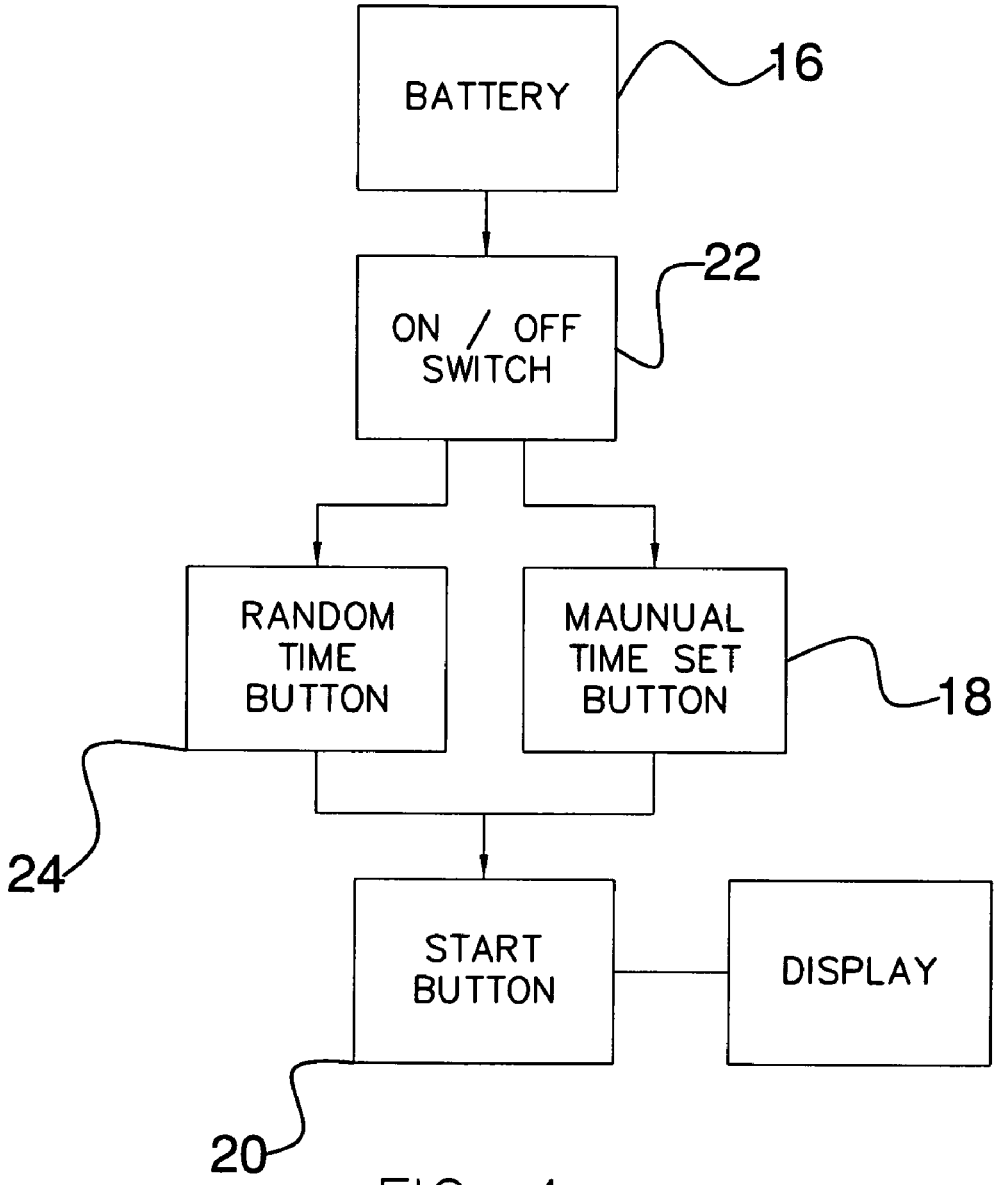
FIG. 4 is a schematic view of the present invention.

With reference now to the drawings, and in particular to FIGS. 1 through 4 thereof, a new diving toy device embodying the principles and concepts of the present invention and generally designated by the reference numeral 10 will be described.

As best illustrated in FIGS. 1 through 4, the diving game assembly and method 10 generally comprises a non-buoyant housing 12 that is substantially waterproof and a digital timer 14 that is mounted in the housing and is configured to count down from a selected number of minutes and seconds down to zero seconds. A power supply 16 is electrically coupled to the timer 12. The power supply 16 is preferably one or more batteries removably positioned with the housing. The timer 14 includes a digital display for displaying the number of minutes and seconds remaining on the timer. A first actuator 18 is electrically coupled to the timer 14 and is configured to selectively add time to the timer 14. A second actuator 20 is electrically coupled to the timer 14 and is configured to start the timer 14. A third actuator 22 is electrically coupled to the timer 14 and is configured to selectively turn the timer 14 on or off. The second 20 and third 22 actuators may be combined into one actuator and the second actuator may be a start and stop actuator. A fourth actuator 24 may be electrically coupled to the timer 14 for selecting a random amount of time to be added to the timer 14. The housing 12 of a first embodiment has a spherical shape. Additional shapes include a plurality of stacked cylinders 26 representing dynamite or a submarine 28. A flexible tether 30 is attached to and extends away from the housing 12. The housing 12 preferably includes weighted lower sections 32 to bias the housing 12 in an upright position.

In use, the timer 14 is set to a selected time or the time is randomly selected with the fourth actuator. The timer 14 is then started and the housing 12 is thrown into a pool of water and the housing 12 is allowed to sink to the bottom of the water. Players then dive for the housing 12 and pull the housing back to a surface of the water. Players may be individual players or teams of players. Additionally, the players may decide if they will throw the housing 12 into the water when they are also the retrieving player or if an opponent will throw the housing to be retrieved by a separate retrieving player. Once retrieved, and if the timer 14 has not reached zero seconds, the housing 12 is thrown back into the pool of water again dove for. The steps of throwing and retrieving the housing 12 are repeated until the timer 14 has reached zero seconds.

Points are gained for each time or occurrence that the housing 12 is brought to the surface by a player. The points are preferably uniform for each occurrence though the players may selectively alter the point structure so that they game is fair for younger children. The player or team with the greatest number of points wins the game.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a water diving game comprising the steps of:

providing a non-buoyant housing, a digital timer being mounted in said housing and being configured to count down from a selected number of minutes and seconds down to zero seconds, a power supply being electrically coupled to said timer, said timer including a digital display for displaying said number of minutes and seconds remaining on said timer;

setting said timer;

starting said timer;

throwing said housing into a pool having water therein and allowing said housing to sink to a bottom of the water;

diving for said housing and retrieving said housing back to a surface of said water before said timer reaches zero seconds.

2. The method according to claim 1, further providing a first actuator being electrically coupled to said timer and being configured to selectively add time to said timer, a second actuator being electrically coupled to said timer and being configured to start said timer, a third actuator being electrically coupled to said timer and being configured to selectively turn said timer on or off.

3. The method according to claim 1, wherein said housing has a spherical shape, a flexible tether being attached to and extending away from said housing.

4. The method according to claim 1, wherein said housing has a shape of a plurality of stacked cylinders, a flexible tether being attached to and extending away from said housing.

5. The method according to claim 1, wherein said housing has a shape of a submarine.

6. A method of playing a water diving game comprising the steps of:

providing a non-buoyant housing, a digital timer being mounted in said housing and being configured to count down from a selected number of minutes and seconds down to zero seconds, a power supply being electrically coupled to said timer, said timer including a digital display for displaying said number of minutes and seconds remaining on said timer, a first actuator being electrically coupled to said timer and being configured to selectively add time to said timer, a second actuator being electrically coupled to said timer and being configured to start said timer, a third actuator being electrically coupled to said timer and being configured to selectively turn said timer on or off, said housing having a spherical shape, a flexible tether being attached to and extending away from said housing;

setting said timer;

starting said timer;

throwing said housing into a pool having water therein and allowing said housing to sink to a bottom of the water;

diving for said housing and retrieving said housing back to a surface of said water;

throwing said housing back into the pool of water if said timer has not reached zero seconds and again diving for the housing;

repeating the steps of retrieving said housing to the surface and throwing said housing back into the water until said timer has reached zero seconds;

gaining points for each time the housing is brought to the surface by a player;

winning the game by having a greatest number of points.

* * * * *